US007230211B2

(12) United States Patent
Weber et al.

(10) Patent No.: US 7,230,211 B2
(45) Date of Patent: Jun. 12, 2007

(54) ELECTRICAL HEATING ELEMENT

(75) Inventors: Hartwin Weber, Hanau (DE); Waldemar Doering, Hasselroth (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 0 days.

(21) Appl. No.: 11/234,980

(22) Filed: Sep. 26, 2005

(65) Prior Publication Data

US 2006/0065653 A1 Mar. 30, 2006

Related U.S. Application Data

(63) Continuation of application No. PCT/EP04/03136, filed on Mar. 24, 2004.

(30) Foreign Application Priority Data

Mar. 28, 2003 (DE) ..... 103 14 218

(51) Int. Cl.
*H05B 1/02* (2006.01)

(52) U.S. Cl. ..... 219/505; 219/504; 219/538; 338/22 R

(58) Field of Classification Search ..... 219/505, 219/504, 497, 494, 523, 538, 548, 552, 553; 338/22 SC, 22 R
See application file for complete search history.

(56) References Cited

U.S. PATENT DOCUMENTS

| | | | | |
|---|---|---|---|---|
| 4,034,330 | A | 7/1977 | Goto | 338/238 |
| 4,489,232 | A * | 12/1984 | Wada et al. | 219/206 |
| 4,639,712 | A | 1/1987 | Kobayashi et al. | 338/238 |
| 4,658,121 | A * | 4/1987 | Horsma et al. | 219/553 |
| 5,093,555 | A | 3/1992 | Dupuis et al. | 219/270 |
| 5,286,952 | A * | 2/1994 | McMills et al. | 219/535 |
| 5,319,180 | A | 6/1994 | Locher et al. | 219/270 |
| 6,204,486 | B1 | 3/2001 | Masaki et al. | 219/444.1 |
| 6,274,855 | B1 * | 8/2001 | Tatematsu et al. | 219/548 |
| 6,420,683 | B1 * | 7/2002 | Chiba et al. | 219/270 |

FOREIGN PATENT DOCUMENTS

| | | |
|---|---|---|
| DE | 3825012 A1 | 1/1990 |
| DE | 197 56 988 C1 | 9/1999 |
| DE | 196 30 402 C2 | 12/2000 |
| DE | 100 60 273 C1 | 12/2001 |
| EP | 0 843 130 A1 | 11/1997 |

OTHER PUBLICATIONS

German Office Action; 103 14 218.5-34; 4 pp.
International Search Report; PCT/EP2004/003136; 13 pp.
International Preliminary Report; PCT/EP2004/003136; 10 pgs.

* cited by examiner

*Primary Examiner*—Mark Paschall
(74) *Attorney, Agent, or Firm*—Baker Botts L.L.P.

(57) ABSTRACT

An electric heating element is provided with a durable PTC resistance made at least partially of an iron-based alloy, exhibiting stable characteristics to a temperature of 1500 DEG C. and having a resistance/temperature characteristic curve which substantially increases in a linear manner within a temperature range between an ambient temperature and 1500 DEG C. and can be used for a temperature control. The PCT resistance is provided with an oxidation resistant metallization or is gas-tightly enveloped by a jacket (2, 3, 12), a space between the jacket (2, 3, 12) and the PCT resistance (1,13) being filled with a powder or granules (14) which remove an important gas amount from the space.

22 Claims, 1 Drawing Sheet

ELECTRICAL HEATING ELEMENT

CROSS-REFERENCE TO RELATED APPLICATIONS

This application is a continuation of co-pending International Application No. PCT/EP2004/003136 filed Mar. 24, 2004, which designates the United States of America, and claims priority to German application number 103 14 218.5-34 filed Mar. 28, 2003, the contents of which are hereby incorporated by reference in their entirety.

TECHNICAL FIELD

The invention belongs to the area of electrical heating technology, whereby devices, materials or rooms are heated by converting electrical energy into thermal energy.

BACKGROUND

Electrical heating systems are for example used in home technology as heating plates in ovens, in hair dryers and fan heaters, in motor vehicle technology for heating the supercharged air or the catalysts for gasoline or diesel fuel, and in chemical technology at reaction columns. Normally the temperature is measured and the measured value is used, via a closed loop, to control heating elements in order to achieve the desired target temperature.

The heating conductors in use are normally heating conductors based on ferritic FeCr (AL)—or austenitic NiCr (Fe)—alloys. However, these materials are rather difficult to use for a more finely tuned temperature because of the low temperature dependence of their specific resistance.

Co alloys with additions of Fe, Ni and similar metals have proven their worth for spark plugs in combustion engines, but they are also quite expensive because of their high Co content. In addition, the specific resistance value is very low in such materials, making it necessary to add other resistors for a better adaptation to the internal resistances of existing power sources.

DE 3825012 A1 describes a control element for a spark plug consisting of a cobalt-iron alloy with about 20–35% iron. This alloy morphs into a cubic area-centered crystalline structure beyond about 1,000° Celsius which, because of the frequent temperature changes and the associated phase transformations, leads to the material's thermal fatigue.

According to EP 0523062, cobalt-iron alloys with an iron content of 6–18% that avoid the effect of thermal fatigue are also used. These alloys have the advantage of a high temperature factor, but their disadvantage is the high price.

The use of pure Fe leads to a pronounced temperature-dependence of the resistance, but there are problems with phase transformations in the interesting temperature range above 900° Celsius. This leads to a hysteresis behavior resulting in an ambiguous temperature resistance curve and in thermal fatigue that can lead to rupture.

In addition, at low temperatures and/or low heat volumes the temperature-dependence of a single resistor is currently also used, which in turn itself serves as heat resistance.

SUMMARY

In order to overcome most of the above problems, DE 100 60 273 proposes again a two-part arrangement with a temperature sensor element that is separate from the heating element and serves as a compensating resistor; however, this entails higher expenses because of its two-part nature.

The purpose of the present invention is to find an inexpensive heating element with alloys that are stable in the mentioned application range, making even applications at high temperatures and great heat volumes possible.

The purpose can be achieved by an electrical heating element with a PTC resistor intended for heating and regulating made at least partially of an iron-based alloy, comprising continuous and constant properties when operated up to 1,500° C. and does not have any crystallographic grid conversions, and a resistance/temperature curve rising in the temperature range between room temperature and 1,500° C., and the rise of which in the temperature range between room temperature and about 750° C. is so steep that the temperature of the PTC resistor can be set to a target temperature using its own temperature behavior. The invention also includes preferred applications such as in a glass ceramic cooking appliance.

Specifically, an electrical heating element according to the invention contains a PTC resistor made partially but preferably entirely of an iron-based alloy that displays constant and unchanging properties when operated up to 1,500° C. and does not exhibit any crystallographic grid conversion, i.e. no phase transformations, and which has a rising resistor-temperature curve in the temperature range between room temperature (RT) and 1,500° C. whose incline in the temperature range between RT and about 750° C. is so steep that the temperature is adjustable to a target temperature via the temperature behavior of the PTC resistor, whereby the heating element is enclosed in a gastight sheathing and the space between the sheathing and the PTC resistor can be filled with an electrically insulating material (e.g. powder or granulate), which displaces most of the gas inside the sheathing.

Preferably only one resistor (PTC resistor) is required for heating and adjusting, thus serving as both a heat resistor and a variable or temperature sensor resistor. In addition it is of advantage if it can be used also for heating plates, hair dryers and fan heaters.

The invention thus concerns an electrical heating element with one PTC resistor (PTC=positive temperature coefficient) that can be operated constantly at unchanged properties not only below 900° Celsius but also in the temperature range between 900° Celsius and 1,500° Celsius and is characterized by a steeply rising resistance/temperature curve (R/T curve) in the temperature range between 20° Celsius and 750° Celsius. It is sufficient if the resistance temperature curve (R/T curve) rises only moderately between 750–1,500° C.

It has been found that the materials that satisfy the above mentioned requirements are susceptible to the influence of the surrounding gases, in particular oxygen.

To deal with this issue, the invention ensures

- that the PTC resistor is enclosed in a sheathing and gastight,
- that the space between the sheathing and the PTC resistor is filled with a powder or granulate that displaces most of the gas inside the sheathing, and
- that at least some of the powder/granulate consists of a material that binds the gas, in particular oxygen, or, in an alternative embodiment,
- that the PTC resistor has an oxidation-proof, high temperature-resistant metallic coating, preferably a nickel coating.

In addition to the nickel coating nickel/chromium coats, chromium coats or other metallizations are also conceivable.

In particular when using Fe-containing alloys (for example iron-based alloys) there is the great risk of scaling (see tables 1, 2, 3: Dz: scaling thickness after 2 h 1,150° C. in ambient air) or internal oxidation due to the oxidation of the iron, and/or of the admixes, creating a layer on the PTC resistor that prevents the flow of electric power, and which thus contributes nothing to heating and to some extent thermally insulates the remaining metal part of the PTC resistor. The internal oxidation also changes the conductive cross-section of the PTC resistor and thus its electrical resistance. This makes it difficult to regulate the temperature on the basis of the R/T curve of the heating element because the control is tuned to a certain cross-section and a certain length of the PTC resistor as defined electrical conductor.

By displacing the gas inside the sheathing with powder/granulate, and by binding the gas to the surface of the powder/granulate, the volume of gas inside the sheathing that can react with the PTC resistor is minimized.

Yet the material binding the gas can be such that a physisorbtion of the gas takes place at the surface of the material whereby the gas molecules are practically glued to the surface of the material. For this purpose the material may be also be designed as porous in order to increase the surface. On the other hand the material can also be such that a chemisorbtion or a chemical reaction (getters) with the gas takes place that results in a bonding of the gas. In either case the resulting gas bond should, if possible, be stable even at the high temperatures occurring in the heating element.

Fe-based alloys have somewhat different properties depending on the admixture, but they all have in common a relatively strong temperature dependence of the electrical resistor and a monotone progress of that dependence.

Fe—Ti alloys (iron-titanium alloys), Fe—V alloys (iron/vanadium alloys) and Fe—Mo alloys (iron/molybdenum alloys) have proven to be particularly advantageous in the sense of the invention. The iron/titanium alloys actually show the strongest temperature dependence of the resistor, iron/molybdenum show less scaling than the other iron-based alloys, and iron/vanadium alloys show the greatest control range, i.e. the largest range in which the steepness of the R/T curve is sufficient for an active and reliable control. These alloys have in common that they maintain essentially a cubic interior-centered grid structure during operation.

The heavy temperature dependence of such iron alloys has to do with their ferromagnetic properties. The temperature dependence is extreme for alloys with the highest saturation magnetization. This is normally accompanied by a high Curie temperature (see the table below, $T_c$). The Curie temperature determines the anomalous temperature range of the resistor.

Pure iron displays a phase transformation of a iron to γ iron in the temperature range between 900° Celsius and 1,400° Celsius, i.e. from a cubic room-centered to a cubic area-centered crystalline structure. Since constant phase transformations lead to thermal fatigue, other components are added to iron (iron alloys), making it possible to prevent phase transformations. Al or Cr, Ti or V, Mo or Si are particularly well suited. Binary alloys can be used as alloys also with more than two partners. When heated and subsequently cooled, such alloys display a nearly hysteresis-free progress of the temperature coefficient.

It has been proven that the alloys with aluminum and chromium or silicon have somewhat worse properties than the variants with titanium, vanadium or molybdenum. This is due to the fact that aluminum shows a resistance change that is too high, and that when adding chromium too much chromium is necessary to satisfy the requirement of preventing phase transformations.

Specifically the following alloys have proven advantageous: 2.0–4.0% Mo by weight, remainder Fe, or 1.00–2.5% V by weight, remainder Fe, or 0.75–2.0% Ti by weight, remainder Fe, including the usual (melting-related) impurities.

The following alloys also have proven quite advantageous: 2.0–3.0% Mo by weight, remainder Fe, or 1.25–1.75% V by weight, remainder Fe, or 1.0–1.5% Ti by weight, remainder Fe, including the usual (melting-related) impurities.

The alloys with molybdenum are particularly impervious to scaling and therefore make the remaining gas volume and leakage rate less critical; the alloys with vanadium have particularly high melting points (about 1,530° Celsius) and Curie temperatures and therefore need the highest modulation. The Ti alloy variants show the steepest rise between RT and 1,000° C. and thus the best control sensitivity (for example temperature factor>6, for FeTi>7).

The use of ceramic material as powder or granulate for filling the spaces between the sheathing and the PTC resistor has proven advantageous for electrical heating elements with a PTC resistor as described above. Ceramic material is sufficiently insulating to prevent a short circuit between the heating element and the possibly metallic sheathing and is also temperature-stable, with the result that it does not change its properties when the temperature is increased.

However, the material in the spaces in between should be an especially good conductor of heat, which is rather the exception in ceramic powders or ceramic granulates, except for example in case of AlN. What helps in this case is packing the powder or granulate densely, i.e. for example by compression or compactation during the manufacture of the heating element. This has the advantageous side effect of further reducing or decreasing the spaces in the powder that enclose the gas. This has the result that even less gas is available for reaction at the surface of the PTC resistor.

A mixture of various grain sizes, down to the smallest manageable grain size, may also be used as powder/granulate. Such mixtures of materials with different grain sizes allows for very high-density packs of pourable material.

Also, getter material (e.g. Al or Zr powder) can be used inside the sheathing. These materials easily bind oxygen, reducing thereby the scaling of the material of the PTC resistor even further. While aluminum or zirconium are electric conductors, they must not be allowed to form a conducting bridge between the PTC resistor and the sheathing. However, they oxidize to non-conducting oxides, which are then harmless.

It is also possible for the powder/granulate to contain aluminum or zirconium powder. In this case the aluminum or zirconium powder for example may be mixed with a ceramic powder so that it has the overall conductivity of an insulator. Even though, there is enough aluminum or zirconium everywhere on the heating element in order to bind gas, in particular oxygen.

In an advantageous embodiment of the electrical heating element according to the invention the sheathing may be a metal tube. In this case the sheathing conducts the heat created in the PTC resistor particularly well because metals, as is well known, are good heat conductors. In this case the metal tube is made of an alloy that has a resistance to heat and scaling corresponding to the temperature value to be generated.

Moreover, the sheathing may be glued, soldered or welded to the object to be heated. When the heating element according to the invention is used in such a way it can be positioned particularly well, ensuring, by the physical contact with the object to be heated, a particularly good heat transfer.

The electrical heating element according to the invention may very advantageously be connected to a glass ceramic cooking element by creating a space between an upper cover plate and a lower cover plate of the glass ceramic cooking element in which the PTC resistor is inserted, whereby as much as possible of the space in between is filled with a ceramic powder/granulate and the space has a gastight seal. In this way the sheathing of the heating element consists of the cover plates and, by filling the space with the powder/granulate, the volume of the gas in the space, which might lead to the scaling of the PTC resistor, is minimized.

The electrical power is preferably supplied to the PTC resistor by way of a gastight glass duct. This ensures that the space between the cover plates is indeed closed gastight.

Another advantageous embodiment of the invention provides that at least one of the cover plates has grooved depressions to accommodate the coils of the PTC resistor. This means that not only is the position of the PTC resistor precisely fixed but also the length of the PTC resistor that corresponds to the heat output, with the result that at a known diameter of the PTC resistor and at the length of the PTC resistor specified by the grooved depressions, its resistance is specified in reproducible fashion and the temperature can thus be regulated easily by setting a certain power voltage. This is important in particular whenever such heating elements must be installed in mass-produced glass ceramic cooking elements, with no further calibration of the individual heating elements being necessary after that.

Also, by putting grooves in the cover plates the space in between actually gets smaller, thereby further reducing the gas volume that could potentially react with the PTC resistor.

The additional material in the form of a powder/granulate that is added to the in-between space in order to bind the gas may for example be mixed into the ceramic powder. However, it is also conceivable according to the invention that at least one separate pocket-like space, specifically ending in a frit, is provided to accommodate the powder/granulate that binds the gas (getter powder). In this case the material (getter powder) may specifically be exchanged and replaced with new getter powder, for example when replacing the PTC resistor. The frit allows for a gas exchange within the in-between space with the pocket-like space possible, making it possible to bind the gas there, but with any dust being kept away from the getter powder. Aluminum or zirconium powder may be used as getter powder in this case also.

BRIEF DESCRIPTION OF THE DRAWINGS

In what follows the invention is explained in more detail using the illustrations of the examples of embodiment shown in the drawings.

DETAILED DESCRIPTION

Figure 1:
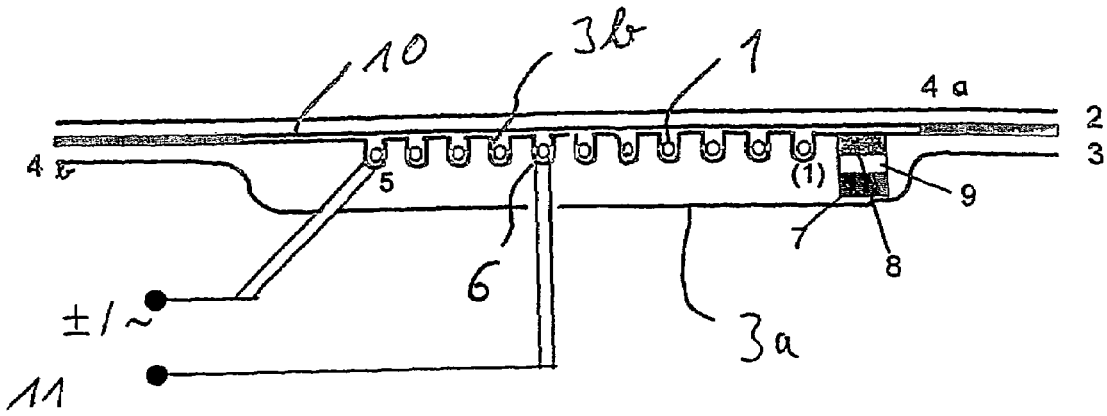
FIG. 1 shows a diagram of the cross section of a glass ceramic cooking element.

FIG. 1 shows the cross section of the upper cover plate 2 and the lower cover plate 3 forming a space in between (10). The latter is sealed gastight in the area of the joints 4, for example by gluing. The lower cover plate 3 has a thickened area 3*a* where the PTC resistor is supposed to go. The latter is set in the grooves or a groove 3*b* of the lower cover plate 3. The PTC resistor 1 is connected to it by way of a glass duct 5 leading through the lower cover plate 3 to the exterior and to a power supply 11. There is also an intermediate contact 6 to which the other end of the PTC resistor is connected and which in turn is connected to the other pole of the power supply 11.

The space 10 between the upper cover place 2 and the lower cover plate 3 has a pocket-like depression 9 which is covered by frits 8 and contains in its interior in the area 7 an aluminum or zirconium powder as getter powder.

In addition the space 10 especially in the area of the grooves 3*b* is filled for the most part with a ceramic powder (e.g. porcelain powder, glass ceramic powder, quartz sand) of different grain size.

Figure 2:
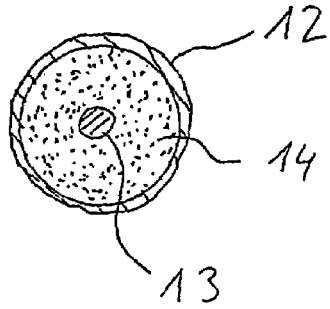
FIG. 2 shows a cross section of a mineral-insulated conductor.

FIG. 2 shows a diagram of a mineral-insulated conductor with a sheathing 12 consisting of a temperature-resistant metal, a PTC resistor 13 made of an iron-based alloy according to the invention and between these a layer 14 consisting of a ceramic powder into which is mixed some aluminum or zirconium powder. The powder is compacted during the production of the mineral-insulated conductor or the sheathing is compressed so as to achieve a greater packing density of the powder and thereby reduce the gas bubbles inside the sheathing to the extent possible.

The following tables show a few iron-based alloys that may be used according to the invention as materials for a PTC resistor. In addition, a few materials that do not meet the requirements of the invention are shown for comparison's sake. The materials shown are accompanied by the specific resistance values at certain temperatures (Rho 1000 and Rho 20) as well as the temperature factor that indicates the steepness of the R/T curve and the melting temperature Tm as well as the Curie temperature Tc. Dz indicates the thickness of scaling after 2 h at 1,150° C. in ambient air. If it is not indicated, the oxidation is not limited to the surface (inner oxidation).

TABLE 1

| Material | 2.0% by weight Mo, remainder | 2.5% by weight Mo, remainder | 3.0% by weight Mo, remainder | 1.25% by weight V, remainder | 1.50% by weight V, remainder | 1.75% by weight V, remainder |
|---|---|---|---|---|---|---|
| Rho 1000 (μΩm) = | 1.146 | 1.126 | 1.152 | 1.136 | 1.141 | 1.143 |
| Rho 20 (μΩm) = | 0.156 | 0.168 | 0.18 | 0.145 | 0.157 | 0.166 |
| Delta Rho/% to alloy (μΩm) = | 0.029 | 0.028 | 0.027 | 0.037 | 0.038 | 0.038 |
| Temp. factor (1000/20) = | 7.346 | 6.702 | 64.4 | 7.834 | 7.268 | 6.886 |
| Tm. ca. (° C.) = | 1520 | 1517 | 1514 | 1529 | 1527 | 1525 |

TABLE 1-continued

| Material | 2.0% by weight Mo, remainder | 2.5% by weight Mo, remainder | 3.0% by weight Mo, remainder | 1.25% by weight V, remainder | 1.50% by weight V, remainder | 1.75% by weight V, remainder |
|---|---|---|---|---|---|---|
| Tc. ca. (° C.) = | 765 | 764 | 763 | 780 | 783 | 786 |
| Dz (mm) = | <0.03 | <0.02 | <0.01 | | | |
| Part of the invention | yes | yes | yes | yes | yes | yes |

TABLE 2

| Material | 1.0% by weight Ti, remainder Fe | 1.5% by weight Ti, remainder Fe | 8.0% by weight Fe, remainder Co | Fe | 1.1% by weight Al, remainder Fe | 1.5% by weight Al - 1.5% by weight Cr, remainder Fe |
|---|---|---|---|---|---|---|
| Rho 1000 (μΩm) = | 1.16 | 1.166 | 0.81 | 1.124 | 1.188 | 1.225 |
| Rho 20 (μΩm) = | 0.1439 | 0.168 | 0.071 | 0.099 | 0.229 | 0.378 |
| Delta Rho/% to alloy (μΩm) = | 0.045 | 0.048 | | | 0.118 | 0.093 |
| Temp. factor (1000/20) = | 8.06 | 6.94 | 11.41 | 11.354 | 5.118 | 3.241 |
| Tm. ca. (° C.) = | 1514 | 1504 | 1480 | 1534 | 1530 | 1525 |
| Tc. ca. (° C.) = | 734 | 717 | 1005 | 769 | 759 | 755 |
| Dz (mm) = | | | 0.1–0.25 | <0.1 | | |
| Part of the invention | yes | yes | no | no | no | no |

TABLE 3

| Material | 2% by weight Al-2% by weight, remainder Fe | 13.5% by weight Ci, remainder Fe |
|---|---|---|
| Rho 1000 (μΩm) = | 1.247 | 1.21 |
| Rho 20 (μΩm) = | 0.463 | 0.4307 |
| Delta Rho/% to alloy (μΩm) = | 0.091 | 0.025 |
| Temp. factor (1000/20) = | 2.693 | 2.8 |
| Tm. ca. (° C.) = | 1520 | 1500 |
| Tc. ca. (° C.) = | 750 | 760 |
| Dz (mm) = | | <0.01 |
| Part of the invention | no | no |

All the alloy data include the usual, melting-related impurities of, for example, C, O, N, S and deoxidation additives such as Mn and Si.

What is claimed is:

1. An electrical heating element with a PTC resistor intended for heating and regulating made at least partially of an iron-based alloy, comprising a continuous and constant property selected from scaling, oxidation and admix properties and no crystallographic grid conversions when operated up to 1,500° C., and a resistance/temperature curve that rises in the temperature range between room temperature and 1,500° C., and wherein the portion of the resistance/temperature curve in the temperature range between room temperature and about 750° C. rises at a sufficiently steep degree that the temperature of the PTC resistor is settable to a target temperature using its own resistance/temperature characteristics.

2. An electrical heating element according to claim 1, wherein the PTC resistor has a metal coating, in particular a nickel coating.

3. An electrical heating element according to claim 1, wherein the PTC resistor is enclosed by a gastight sheathing and that the space between the sheathing and the PTC resistor may be filled with an electrically insulating material that displaces most of the gas inside the sheathing.

4. An electrical heating element according to claim 3, wherein the electrically insulating material is a powder or a granulate.

5. An electrical heating element according to claim 4, wherein at least some of the powder/granulate is a material that binds gas.

6. An electrical heating element according to claim 1, wherein the PTC resistor consists at least partially of one of the following Fe-based alloys: Fe-T-alloys, Fe—V alloys, Fe—Mo alloys.

7. An electrical heating element according to claim 1, wherein the PTC resistor consists at least partially of an alloy of the following compositions including impurities: 2.0–4.0% Mo by weight, remainder Fe; or 1.0–2.50% V by weight, remainder Fe; or 0.75–2.0% Ti by weight, remainder Fe.

8. An electrical heating element according to claim 7, wherein the PTC resistor consists at least partially of an alloy of the following compositions including impurities: 2.0–3.0% Mo by weight, remainder Fe or 1.25–1.75% V by weight, remainder Fe or 1.0–1.5% Ti by weight, remainder Fe.

9. An electrical heating element according to claim 3, wherein the powder or granulate contains an electrically insulating ceramic material.

10. An electrical heating element according to claim 9, wherein the ceramic material is AlN.

11. An electrical heating element according to claim 9, wherein the powder/granulate includes a mixture of various grain sizes down to the smallest manageable grain size.

12. An electrical heating element according to claim 3, wherein all or part of the inside of the sheathing is getter material.

13. An electrical heating element according to claim 12, wherein at least some of the getter material is Al or Zr powder.

14. An electrical heating element according to claim 3, wherein the sheathing takes the form of a metal tube.

15. An electrical heating element according to claim 3, wherein the sheathing is glued, soldered or welded to the object to be heated.

16. A method of using an electrical heating element in a glass ceramic cooking element, comprising the steps of:

providing a PTC resistor intended for heating and regulating made at least partially of an iron-based alloy, comprising a continuous and constant property selected from scaling, oxidation and admix properties and no crystallographic grid conversions when operated up to 1,500° C., and a resistance/temperature curve that rises in the temperature range between room temperature and 1,500° C., and the portion of the resistance/temperature curve in the temperature range between room temperature and about 750° C. rises at a sufficiently steep degree that the temperature of the PTC resistor is settable to a target temperature using its own resistance/temperature characteristics;

providing a space between an upper cover plate and a lower cover plate, inserting the PTC resistor in the space, and sealing the space gastight.

17. A method according to claim 16, wherein the in-between space is at least partially filled with filler material.

18. A method according to claim 17, wherein that the filler material is a ceramic powder/granulate.

19. A method according to claim 16, wherein the electrical power is supplied to the PTC resistor via a gastight glass duct.

20. A method according to claim 17, wherein the PTC resistor has at least some coils and that at least one of the cover plates has grooved depressions to accommodate the coils of the PTC resistor.

21. A method according to claim 16, wherein at least one separate pocket-like space is provided to hold the getter powder for binding the gas.

22. A method according to claim 21, wherein the pocket-like space ends in a frit.

* * * * *